US006237639B1

(12) United States Patent
Jougla et al.

(10) Patent No.: US 6,237,639 B1
(45) Date of Patent: May 29, 2001

(54) DUMP-VALVE DEVICE FOR A CRAFT AND PNEUMATIC CRAFT FITTED WITH SAME

(75) Inventors: Daniel Jougla, Labege; Pierre Valax, Montgiscard, both of (FR)

(73) Assignee: Zodiac International, Issy Les Moulineaux (FR)

( * ) Notice: Subject to any disclaimer, the term of this patent is extended or adjusted under 35 U.S.C. 154(b) by 0 days.

(21) Appl. No.: 09/267,744

(22) Filed: Mar. 15, 1999

(30) Foreign Application Priority Data

Mar. 18, 1998 (FR) ..... 98 03311

(51) Int. Cl.[7] ..... A01G 25/09

(52) U.S. Cl. ..... 137/899.2; 251/267; 251/252; 251/144; 114/198; 114/197; 114/440

(58) Field of Search ..... 137/899.2; 251/252, 251/144, 267; 114/197, 198, 440

(56) References Cited

U.S. PATENT DOCUMENTS

| | | | | |
|---|---|---|---|---|
| 1,669,276 | | 5/1928 | Baldwin . | |
| 2,343,134 | * | 2/1944 | Cawood | 251/267 |
| 3,565,031 | | 2/1971 | DePersia . | |
| 3,859,945 | * | 1/1975 | Moeller | 114/197 |
| 4,019,454 | * | 4/1977 | Landwerlen | 114/197 |
| 4,198,918 | * | 4/1980 | Patriarca et al. | 114/197 |
| 4,217,846 | * | 8/1980 | Wight | 114/185 |
| 4,516,515 | * | 5/1985 | Johnson | 114/197 |
| 4,717,119 | * | 1/1988 | Trin | 251/144 |
| 4,930,657 | * | 6/1990 | Walker | 220/235 |
| 5,048,556 | * | 9/1991 | Grumelot et al. | 137/270 |
| 5,176,097 | * | 1/1993 | Bonin et al. | 114/183 R |
| 5,246,202 | * | 9/1993 | Beamer | 251/252 |
| 5,285,999 | * | 2/1994 | Scholz | 251/252 |
| 5,364,069 | * | 11/1994 | Minner et al. | 251/144 |
| 5,368,181 | * | 11/1994 | Myers | 220/303 |
| 5,385,108 | * | 1/1995 | Thompson | 114/197 |
| 5,522,338 | * | 6/1996 | Eilert et al. | 114/345 |
| 5,722,451 | * | 3/1998 | Godeau et al. | 137/315 |
| 6,007,047 | * | 12/1999 | Phipps | 251/252 |

FOREIGN PATENT DOCUMENTS 502993 7/1930 (DE) .

* cited by examiner

*Primary Examiner*—A. Michael Chambers
*Assistant Examiner*—Thomas L. McShane
(74) *Attorney, Agent, or Firm*—Dean W. Russell; Kilpatrick Stockton LLP

(57) ABSTRACT

A dump-valve device for a craft, characterized in that it comprises: a plug valve (13) movable approximately rectilinearly relative to a fixed seat (17) supported by a craft transom plate (3), drive means (9, 10) mobile in rotation along a rotary stroke of limited angular amplitude and able to be activated from inside the craft, and coupling means (11, 19) interposed between the valve (13) and the drive means (9, 10) to convert the rotary stroke of limited angular amplitude of the drive means into a rectilinear stroke of limited linear amplitude of the valve.

15 Claims, 2 Drawing Sheets

DUMP-VALVE DEVICE FOR A CRAFT AND PNEUMATIC CRAFT FITTED WITH SAME

The present invention concerns improvements made to dump-valve devices fitted to crafts and in particular pneumatic crafts.

By dump-valve device, otherwise said self-bailer device, is understood a manually or automatically operating plugging device allowing the discharging of water which has entered a craft, and particularly a flexible bodied pneumatic craft wherein the volume between the flexible body (canvas stretched into a V-shape), the floor and the bottom of the transom plate is not sealed.

Currently, dump-valve devices for pneumatic crafts are essentially arranged in the form of a plug engaged in a passage passing through the transom plate.

In the case of flexible bodied crafts, the dump valve is located at the extreme bottom of the transom plate, opposite the lower point of the body, and the plug must be removed or put in place from the outside of the boat, by leaning over the transom plate and thrusting a hand into the water, which is restricting for the user.

In the case of stiff bodied crafts (a stiff body defines a volume closed in a sealed way), a dump-valve device is generally speaking provided at the junction of the transom plate and the floor to allow the water shipped over the edge to be discharged. For the dump-valve device to be effective, it is necessary to place it slightly under the level of the floor and, so that the plug can be controlled, it is necessary to clear a space by cutting out notably the back of the floor. The result is a difficulty in the manufacture of the floor and in the making of its connection with the transom plate.

For flexible bodied pneumatic crafts, a second dump-valve device can also be provided at the junction of the transom plate and the floor, as in the previous case and with the same drawbacks.

There is therefore currently a unsatisfied demand for a dump-valve device which can be handled straightforwardly and easily from inside the craft and which does not require a particular configuration of the back edge of the floor (elimination of the indentation).

To this end, the invention proposes a dump-valve device for a craft which is characterized in that it includes:

a plug valve movable approximately rectilinearly relative to a fixed seat supported by a transom plate of the craft, drive means mobile in rotation along a rotary stroke of limited angular amplitude and able to be activated from inside the craft, coupling means interposed between the valve and the drive means to convert the rotary stroke of limited angular amplitude of the drive means into a rectilinear stroke of limited angular amplitude of the valve.

In a preferred embodiment, the device comprises:

a cylindrical body suitable to be fixed in a through hole provided in the craft transom plate, a coupling ring coaxial to the body and mounted to rotate in a longitudinal portion of the body facing inwards to the craft, stop means being provided to limit angularly the rotary stroke of the coupling ring in the body, said plug valve being engaged in said body and comprising a plug head suitable to engage in a sealed way with said seat provided towards the end of the body located outside the craft and a valve body of cylindrical shape extending coaxially into the tubular body and into the coupling ring, said coupling means being of the pin-groove type provided on the valve body and on the coupling ring to convert the angular movement of specified amplitude of the ring into an axial rectilinear movement of specified amplitude of the valve, passage means provided on the valve and/or the tubular body and the coupling ring to permit the outflow of the water contained in the craft when the valve is open, and said activation means being mechanically integral with the coupling ring and extending above the craft floor to enable the opening/shutting of the valve of the dump-valve device to be controlled from inside the craft.

By means of the arrangements of the invention, a dump-valve device is constituted which is able to be activated in a straightforward way from inside the craft, even when it is located at the lower part of the transom plate on flexible bodied crafts.

The coupling and drive means of the different parts can be made structurally straightforward and operationally reliable even in particularly turbulent weather conditions at sea. Thus, provision can be made for the angular rotation stop means of the ring in the body to include at least one groove cut in the inner face of the body and to extend circumferentially approximately tranversally to the axis of the body, on a specified angular amplitude, and for the ring to be fitted with a radially outward projecting pin, engaged in said groove. It can also be arranged for the coupling means of the valve body and of the coupling ring to include a groove cut in the outer face of the valve body in its part engaged in the coupling ring, said groove extending on a specified angular amplitude being inclined relative to the axis of the valve body, and a pin carried by said ring, projecting radially inwards and engaged in said groove. It is possible to combine to great advantage the two previous arrangements and to provide for the two grooves cut respectively on the inner face of the tubular body and on the external face of the valve body to be situated approximately opposite each other on either side of the wall of the coupling ring, and for the coupling ring to be fitted with a fixed, through spindle, the ends of which projecting radially on either side constitute the two above-mentioned pins engaged respectively in the two above-mentioned grooves; in this case, it is advantageous for the groove cut in the tubular body to be a through groove, in the shape of an elongated port, and for the spindle to be fixed in the coupling ring through said port, by means of which arrangement said spindle acts as an assembly component of the tubular body, of the coupling ring and of the valve. Thus is constituted a structure of extreme simplicity wherein the three constituent parts, mobile relative to each other with movements of different types and directions, remain mechanically assembled by a single and same component, namely the above-mentioned spindle.

Preferably, to ensure the reliability of the valve movement, provision is made to attach to the device axial groove and projecting pin guide means provided on the inner face of the tubular body and the outer face of the valve in such a way that the valve is activated by an axial rectilinear movement in the body.

Still in the interests of straightforward manufacture, it is desirable for the valve body to be tubular, for ports to be cut in said valve body at the back of the plug head and for the activation ring to be hollowed out axially. Additionally, this arrangement enables the incorporation, inside the valve body or the coupling ring, of a membrane valve able to be deformed resiliently outwards in the direction of the opening under the action of the pressure of the water present inside the craft.

To facilitate the assembly of the dump-valve device on the transom plate, whatever the thickness of the latter, provision is made for the tubular body to comprise, at its end fitted with the activation ring, a flange suitable to press on the inner face of the transom plate and, at it other end fitted with the valve, an external thread intended to receive a screwing nut suitable to be supported against the outer face of the transom plate.

In a very advantageous way, the activation means include a radial arm integral with the coupling ring and suitable to extend along the inner face of the transom plate as far as the top of the craft floor: adjustment of the length of the arm thus allows the dump-valve device to be mounted in any location on the transom plate, either in the bottom of the latter (i.e. below the floor), or flush with the floor, while still retaining an extreme simplicity of control. Additionally, the fact that the control movement is a rotary movement makes it possible to conceive in a simple way of motorization with transmission reduction by gears.

The invention will be better understood from reading the following detailed description of a preferred embodiment given only as a non-restrictive example. In this description reference is made to the appended drawings in which.

Figure 2:
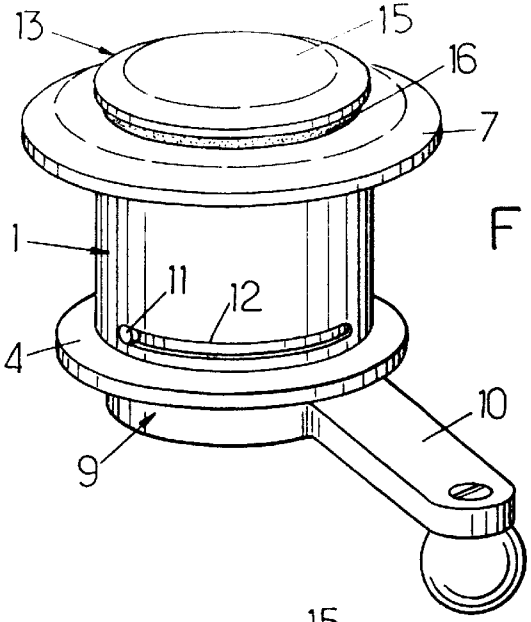
FIGS. 2 and 3 are perspective views of the device in FIG. 1 shown in two different operational positions.
Figure 1:
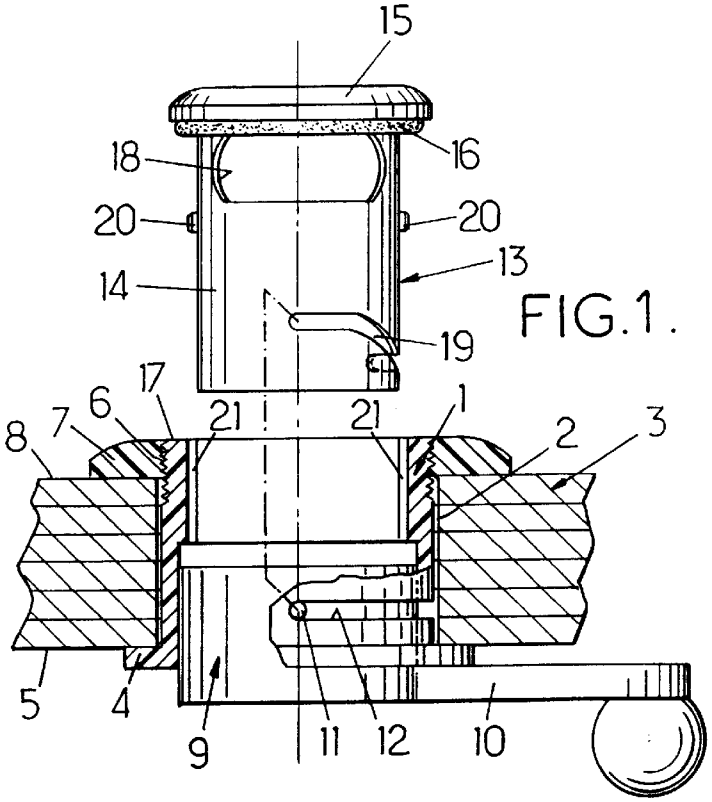
FIG. 1 is a diametrical sectional view, with partial pulling out and partially exploded, of a dump-valve device according to the invention.

Referring firstly to FIGS. 1 and 2, the dump-valve device can include a body 1, preferably of cylindrical revolution, tubular, suitable to be fixed in a through hole 2 provided in a appropriate location on a craft transom plate 3. In order to be locked in an operational position on the transom plate 3, the body 1 can comprise, at its end located facing inwards to the craft, a flange 4 projecting radially suitable to press on the inner face 5 of the transom plate, whereas its opposite end is fitted with an external thread 6 suitable to receive a screwing nut 7 able to be supported against the external face 8 of the transom plate.

A coupling ring 9 is mounted coaxially to the body inside its end which faces inwards to the craft. The ring 9 rotates freely inside the body 1 over a limited angular range. Additionally, activation means are combined with the ring to make it rotate: these activation means, which are preferably of the manual type, include a radial arm 10 integral with the ring, this radial arm extending in an immediate neighborhood of the inner face 5 of the transom plate 3 so as to reduce to the maximum the projection of the device and to restrict to the maximum the cut to be provided in the back edge of the floor.

To lock the ring 9 axially in the body 1 and simultaneously to specify its specified rotation amplitude, provision is made to couple the ring and the body by assembly means of the pin-groove type. For a purpose which will be better understood below, it is desirable for the radially outward projecting pin 11 to be carried by the ring and for the corresponding groove 12 to be cut in the inner face of the body 1 with an circumference located approximately transversally to the body axis. Additionally, in order to simplify assembly, it is desirable for the groove 12 to be a through groove and for it to be in the form of an elongated port.

Lastly, the device comprises a plug valve 13 partly engaged inside the body 1 coaxially to it. The valve 13 comprises, in the embodiment shown, a valve body 14 engaged in the body 1 and in the ring 9 and a plug head 15 carried at the end of the valve body 14 outside the body 1. The plug head 15 can be constituted in the form of a front plate supporting, on its face facing the body, an annular sealing gasket 16, for example an elastomer toroidal sealing ring, suitable to bear, in the plugging position, on the end 17 of the body 1 forming a seat.

Still in the embodiment shown, the valve body 14 is hollowed out internally and has a tubular shape of cylindrical revolution, fitted with through holes 18 at the base of the plug head 15.

To ensure the plugging-opening functions, the valve 13 is axially mobile inside the body 1 with a specified rectilinear movement amplitude. To this end, movement conversion means, preferably of the pin-groove type, are interposed between the ring 9 and the valve 13 to convert the rotation of the ring 9 into a rectilinear movement of the valve 13. To do this, and for a purpose which will become clear below, it is desirable for the ring 9 to be fitted with a radially inward projecting pin (not shown and given no reference number in FIG. 1) and for the valve body 14 to be provided with a groove 19 with a circumference inclined relative to the valve body axis.

In an embodiment which is particularly advantageous by virtue of the structural simplicity to which it leads and of the simplicity and speed of assembly which it confers, the two grooves 12 and 19 are located approximately opposite each other, on either side of the wall of the ring 9, and in these conditions the two pins suitable to coact with each of them and supported by the ring can be located radially in each other's alignment. In this way, it is possible to constitute these two pins in the form of a single component in the shape of a spindle fixed (force fitted, screwed, etc.) through the wall of the ring 9 and the two ends of which projecting on either side of its wall fulfill the required functions.

To ensure a steady and reliable operation of the valve 13, guide means are provided with pins-grooves interposed between the valve body 14 and the body 1. For example, the valve body 14 carries two radially outward projecting and diametrically opposite pins 20, whereas two rectilinear grooves 21, extending axially, are cut in the inner face of the body 1 being approximately diametrically opposite.

Figure 3:
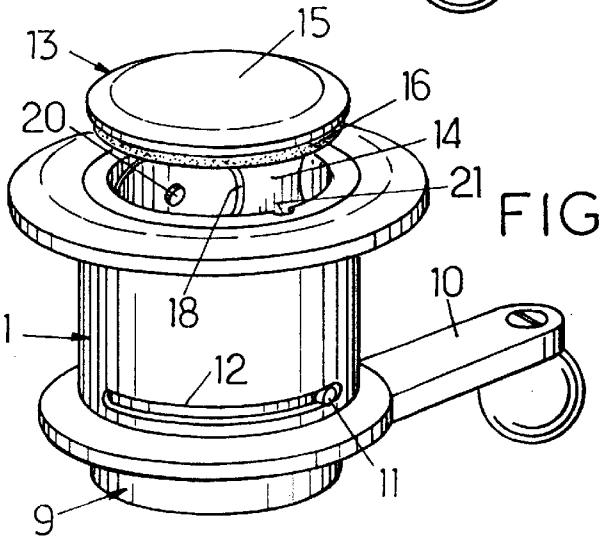

In FIG. 2, the dump-valve device is shown in perspective in the closed position, the valve head 15 held in sealed support against the body 1 by the action of the handle pushed back to the left (in this example), whereas in FIG. 3 the device is shown in the open position with the valve head 15 separated from the body 1 and the openings apparent under the action of the handle 10 turned to the right. Owing to the hollow configuration of all the component parts, the water located inside the craft can flow axially and be discharged through the openings 18.

Figure 4:
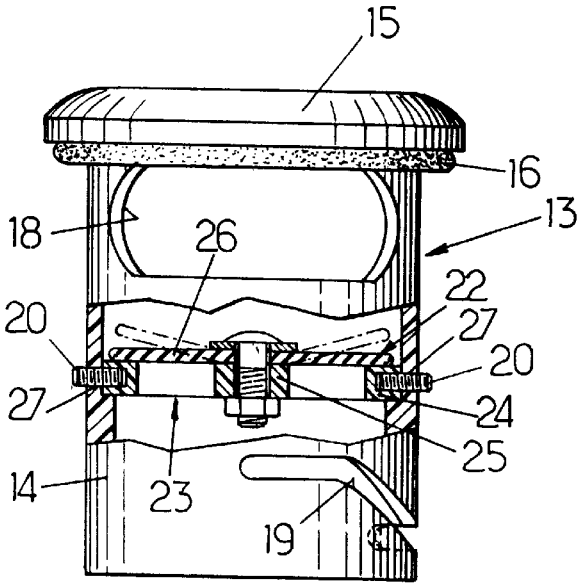
FIG. 4 is a side view with partial diametrical cross-section, of the valve of the device in FIG. 1 fitted internal to an automatically operating plug.

To prevent the internal penetration into the craft of external water when the dump-valve device is open, it is possible to combine it with an automatic valve, such as a membrane valve, which must be placed internally, consequently either in the ring 9, or in the valve body 14. In FIG. 4 one such automatic valve 22 has been shown mounted in the valve body 14 where the space available is greater than inside the ring 9. In a straightforward embodiment, the automatic valve can comprise a rigid support 23 including a circular peripheral ring 24 joined by spokes (not shown) to a central core 25. A flexible, resiliently deformable, (for example of elastomer), disk-shaped membrane 26 is fixed into its middle on the hub 25 on the side of the latter which faces the valve head 15. In the absence of force, the membrane 26 is in sealed support against the ring 24 that forms an annular seat.

Additionally, to fix the support 24 to the valve body 14, screws 27 can be employed which pass radially through the wall of the valve body 14 and penetrate into the ring 24, with the result that the screw 27 heads remain projecting outside the valve body 14 to constitute the above-mentioned guide pins 20.

Clearly, numerous embodiment variations can be conceived. However, the arrangements which have just been described seem bound to be those which give the most advantageous results and the greatest operational reliability given the very harsh conditions to which the device is subjected. The number of component parts is reduced to a minimum, the assembly of the device is straightforward and fast, its assembly on a craft transom plate is straightforward and its replacement easy, its manufacturing cost is minimal, and in the final analysis it is easy to handle.

Although the device of the invention can have application in any kind of craft, it is more particularly intended to be fitted to pneumatic crafts, particularly both pneumatic crafts fitted with a floor and closed at the rear by a transom plate, the dump-valve device being placed on the transom plate at the junction of the latter and the floor, being flush with this latter, and flexible bodied pneumatic crafts fitted with a floor and closed at the rear by a transom plate, the dump-valve device being placed on the transom plate opposite the lowest part of the flexible body, the activation means being configured to extend to the top of the floor (lever arm 10 of great length).

Figure 5:
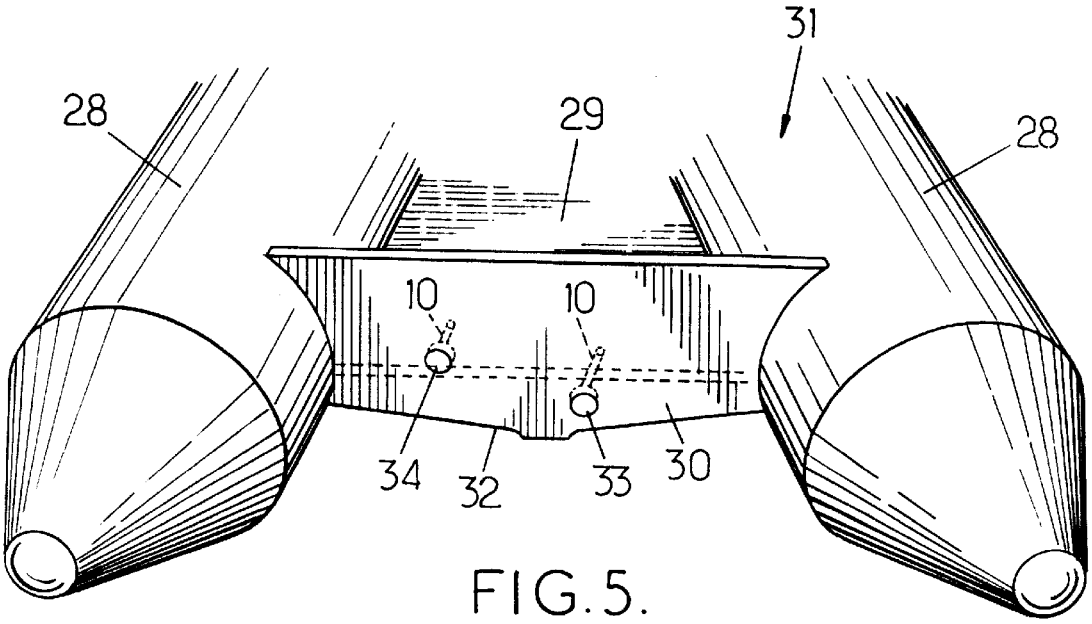
FIG. 5 is a rear view of a pneumatic craft incorporating devices according to the invention.

The rear view of a pneumatic boat 31 with a flexible body (not shown) has been given as an example in FIG. 5; this has, between the two side inflatable buoyancy fenders 28, a rigid floor 29 extending backwards to a transom plate 30, the lower edge 32 of which conforms approximately to the V shape of the flexible body. On this boat the two above-mentioned arrangements have been combined, namely a first dump-valve device 33 mounted approximately towards the lower part of the flexible body to discharge the water enclosed in this body by virtue of its lack of watertightness, and a second dump-valve device 34 located higher than the previous one, at the plank-transom plate junction. The two devices are fitted with respective activation levers having different lengths so that they extend to the top of the floor so as to be easy to handle.

Thus any inward movement of the valve body transversally to the transom plate is eliminated, and the indentation which used to have to be provided to this end in the rear edge of the floor can be eliminated: the manufacture of the floor is simplified by this. There only remains to provide a cutout intended for the passage of the lever arm; however this lever arm does not have a significant thickness and it can be pinned against the transom plate, with the result that this cutout can be of minimal size and making it does not pose a problem.

What is claimed is:

1. A dump-valve device for a boat having a transom provided with a through hole at the lower part thereof, comprising:

a cylindrical tubular body arranged to be fixed in said through hole of said transom with a first end outside the boat, said first end having a valve seat, a plug valve in said tubular body which is movable substantially rectilinearly thereto between a closed position and an open position, and which has a plug head adapted to engage sealingly said valve seat of said tubular body in its closed position, drive means angularly rotatable with respect to said tubular body and provided with operation means located inside the boat and adjacent the transom, coupling means provided between the drive means and the plug valve so as to convert said angular rotation movement of the drive means with respect to said tubular body into said rectilinear movement of said plug valve with respect to said tubular body, and passage means provided in either or both of the plug valve and drive means so as to allow water to outflow from the inside of the boat when said plug valve is in its open position.

2. A dump-valve device according to claim 1, wherein the plug valve comprises a valve body and said coupling means include a coupling ring coaxially located inside said tubular body, between said tubular body and the valve body, and wherein stop means are provided in connection with said coupling ring so as to limit said angular rotation movement thereof with respect to said tubular body.

3. A dump-valve device according to claim 2 in which the boat has an inside, wherein said coupling ring is located inside said tubular body in a part thereof adjacent to the boat inside, and wherein said drive means are directly fixed with said coupling ring.

4. A dump-valve device according to claim 2, where said coupling means between said coupling ring and said tubular body, together with said stop means, include a radially projecting pin provided on either said coupling ring or said tubular body and engaged with a partly annular groove provided in either said tubular body or said coupling ring, respectively.

5. A dump-valve device according to claim 2, wherein said coupling means between said coupling ring and said valve body include a radially projecting pin provided on either said coupling ring or said valve body and engaged with an axially slanted groove provided in either said valve body or said coupling ring, respectively.

6. A dump-valve device according to claim 2, wherein said coupling ring has inner and outer faces and said coupling means between said coupling ring, said tubular body, and said valve body, together with said stop means, include:

a partly annular groove provided in said tubular body, an axially slanted groove provided in said valve body, said annular groove and said axially slanted groove substantially facing each other, and a radial pin supported by said coupling ring and projecting radially on both the inner and outer faces of said coupling ring so as to engage simultaneously said annular and axially slanted grooves.

7. A dump-valve device according to claim 6, wherein the annular groove in said tubular body is a through groove, in the shape of an elongated port, and wherein the radial pin is fixed in said coupling ring through said port, whereby said radial pin is an assembly component of said tubular body, of said coupling ring, and of said plug valve.

8. A dump-valve device according to claim 1 in which the tubular body has an inner face and the plug valve has a valve body with an outer face, wherein axial groove and projecting pin guide means are provided respectively on the inner face of said tubular body and the outer face of said valve body so that the plug valve is operated by an axial rectilinear movement in said valve body.

9. A dump-valve device according to claim 1 in which the coupling means comprises a coupling ring, the plug valve has a valve body, and the plug head has a back and wherein, so as to provide said passage means, said valve body is tubular and ports are provided in said valve body at the back of the plug head and said coupling ring is hollowed out axially.

10. A dump-valve device according to claim 1 in which the tubular body has an annular edge and the plug valve has a valve body and wherein said plug head includes (i) a front plate with a rear face and coaxial to said valve body and integral with it and (ii) an annular sealing gasket integral with the rear face of the front plate so as to engage with the annular edge of the tubular body.

11. A dump-valve device according to claim 2 in which the transom has an inner face and the boat has a floor, wherein said operation means include a radial arm integral with said coupling ring and extending along the inner face of said transom as far as the top of the floor.

12. A dump-valve device according to claim 9, wherein inside said valve body or said coupling ring is placed a membrane valve, the membrane being resiliently deformable outward due to the pressure of water inside the boat, whereby, when said plug valve is in its open position, said membrane valve operates automatically to allow water inside the boat to flow out but to prevent water outside the boat from flowing back into the boat.

13. A dump-valve device according to claim 1 in which the transom has inner and outer faces, the tubular body has a second end, and the coupling means comprises a coupling ring provided at the end of the tubular body, wherein, at its second end, the tubular body comprises a flange suitable to press on the inner face of the transom and, at its first end, the tubular body comprises an external thread adapted to receive a screwing nut suitable to be supported against the outer face of the transom.

14. A dump-valve device according to claim 1, used in a pneumatic boat having a floor and closed at its rear by the transom which extends to the floor, said dump-valve device being located at the junction of said floor and said transom, flush with the floor.

15. A dump-valve device according to claim 1, used in a pneumatic boat having a floor and a fabric-sheet hull and closed at its rear by the transom, said dump-valve device being located on said transom and said operation means being configured to extend as far as the top of said floor.

* * * * *